US006679008B2

(12) United States Patent
Santa Cruz et al.

(10) Patent No.: US 6,679,008 B2
(45) Date of Patent: Jan. 20, 2004

(54) METHOD AND APPARATUS FOR CONSTRUCTING A BUILDING FROM INTERCONNECTING CORRUGATED SHEETS

(76) Inventors: Cathy D. Santa Cruz, 7630 Tholl Dr., Reno, NV (US) 89506; Wayne R. Sandstrom, P.O. Box 549, Wadsworth, NV (US) 89415

( * ) Notice: Subject to any disclaimer, the term of this patent is extended or adjusted under 35 U.S.C. 154(b) by 58 days.

(21) Appl. No.: 10/119,322

(22) Filed: Apr. 8, 2002

(65) Prior Publication Data

US 2003/0188494 A1 Oct. 9, 2003

(51) Int. Cl.[7] ..... E04H 1/00

(52) U.S. Cl. ..... 52/79.1; 52/79.9; 52/79.5; 52/284; 52/270

(58) Field of Search ..... 52/79.1, 79.9, 52/79.5, 284, 270

(56) References Cited

U.S. PATENT DOCUMENTS

| | | | | | |
|---|---|---|---|---|---|
| 4,291,510 | A | * | 9/1981 | Sivachenko | 52/91.3 |
| 5,941,036 | A | * | 8/1999 | Hill | 52/292 |
| 5,966,956 | A | * | 10/1999 | Morris et al. | 62/259.1 |
| 6,131,349 | A | * | 10/2000 | Hill | 52/292 |
| 6,412,231 | B1 | * | 7/2002 | Palatin | 52/79.1 |

* cited by examiner

*Primary Examiner*—Carl D. Friedman
*Assistant Examiner*—Steve Varner

(57) ABSTRACT

A building that may be assembled from only interconnecting corrugated sheets without the need for expensive brackets or specialized assembly tools and which is quick and easy to construct using the novel construction method as taught herein. The building further provides unique roof construction that is extremely strong and eliminates the need for typical roof trusses. Also the building can be custom designed and used for any purpose of consumer choice, and may be sold as a kit with complete assembly instructions.

11 Claims, 2 Drawing Sheets

METHOD AND APPARATUS FOR CONSTRUCTING A BUILDING FROM INTERCONNECTING CORRUGATED SHEETS

FIELD OF THE INVENTION

This invention relates to the construction of buildings in general but more particularly pertains to a building which is formed from interconnecting corrugated sheets and when assembled in the manner as taught herein, provides a building which is portable, is of very simple construction and quick to assemble. Also, the end result is a building that is rot-proof, rust resistant, weather resistant, vermin resistant, seismically sound and is suitable for numerous uses, such as root cellars, buried bomb shelters, etc., depending on user choice.

BACKGROUND OF THE INVENTION

Within the construction business and as taught by the known prior art, there are numerous types of construction methods for erecting various types of buildings, such as homes, office buildings, etc. However, nowhere in the prior art did the applicants find a building which is constructed from interconnected corrugated sheets in the manner as taught herein. Also, within the known prior art most buildings are much to complicated, costly, and time consuming to assemble, and they use many different types of costly construction materials which the present invention eliminates, and this proves to be most advantageous.

It is therefore contended by the applicants, that there is a great need for improvement in the field of constructing buildings, especially when considering the assembly of small buildings, such as those used for storage and the like.

SUMMARY OF THE INVENTION

It is therefore an object of the present invention to provide a method and apparatus for constructing a building from interconnecting corrugated sheets which is economical to manufacture, and is easily marketable.

Another object of the present invention is to provide a method and apparatus for constructing a building from interconnecting corrugated sheets which is of simple construction and can be easily transported in an affordable manner and quickly assembled on site.

Yet another object of the present invention is to provide a method and apparatus for constructing a building from interconnecting corrugated sheets which can be produced in substantially any suitable size of consumer choice.

Another important object of the present invention is to provide a method and apparatus for constructing a building from interconnecting corrugated sheets which does not require any additional tools, other than those typically used on construction sites.

Yet another object of the present invention is to provide a method and apparatus for constructing a building from interconnecting corrugated sheets which includes a unique bending method which is taught in our previously issued U.S. Pat. No. 6,354,130 entitled "METHOD FOR BENDING A CORRUGATED SHEET".

Yet another object of the present invention is to provide a method and apparatus for constructing a building from interconnecting corrugated sheets which allows the consumer to assemble the building on site. Either on an excavated surface, a cement slab, cement blocks, or simply on a level ground surface, as a foundation is not essential.

A very important object of the present invention is to provide a method and apparatus for constructing a building from interconnecting corrugated sheets which when assembled, provides a building which is rot-proof, rust-resistant, weather resistant, varmint resistant and seismically sound.

Also another object of the present invention is to provide a method and apparatus for constructing a building from interconnecting corrugated sheets which forms a building that can be used for substantially anything of user choice. For example, the building can be used for storage purposes, living quarters, a tool shed, a shelter, a tack room, a root cellar, etc.

A further object of the present invention is to provide a method and apparatus for constructing a building from interconnecting corrugated sheets which can include a building having windows, doors, an attic, a carport, or any other specialized feature that the consumer desires.

Yet another object of the present invention is to provide a method and apparatus for constructing a building from interconnecting corrugated sheets which can be custom ordered and manufactured to exact specifications as requested by the consumer.

Also another object of the present invention is to provide a method and apparatus for constructing a building from interconnecting corrugated sheets which includes a unique means for shaping and forming the roof. Whereby providing a roof that is extremely strong and which further distributes the weight and stresses to the exterior edges. This roof system is similar in function to the stresses and forces incurred upon a bow and arrow when in the flexed position. Or another example includes the typical construction of an airplane wing, or the like, which distributes weight in a unique manner that is very similar to the present invention. Also, the roof can be of any suitable shape of engineering choice.

Still another object of the present invention is to eliminate the need for typical roof trusses and/or additional bracing, as a roof constructed in the manner as taught herein is stronger and much more durable than most typical roofs.

Yet a further object of the present invention is to provide a method and apparatus for constructing a building from interconnecting corrugated sheets which can be easily insulated if so desired.

Still another object of the present invention is to provide a method and apparatus for constructing a building from interconnecting corrugated sheets which may further include electrical wiring, electrical outlets, heating and/or cooling means, etc., if so desired.

Yet another object of the present invention is to provide a method and apparatus for constructing a building from interconnecting corrugated sheets which can be produced and sold in the form of a kit, including complete assembly instructions.

Other objects and advantages will be seen when taken into consideration with the following specification and drawings.

DETAILED DESCRIPTION OF THE DRAWINGS

Referring now in detail to the drawings wherein like characters refer to like elements throughout the various views.

The present invention substantially teaches the assembly and construction method for building a structure, such as a storage shed or the like. However, it is to be understood the assembly and construction method as taught herein can be used to build substantially any type, style, size, or shape of building of manufacturing choice. Therefore the following description is only exemplary of one possible embodiment and thus the invention is not to limited to the building as depicted and described herein.

It is to be further understood that the noted building can be made from substantially any suitable building panels of engineering choice, such as from interconnected corrugated metal sheets, and again the panels as described herein are only exemplary.

Figure 1:
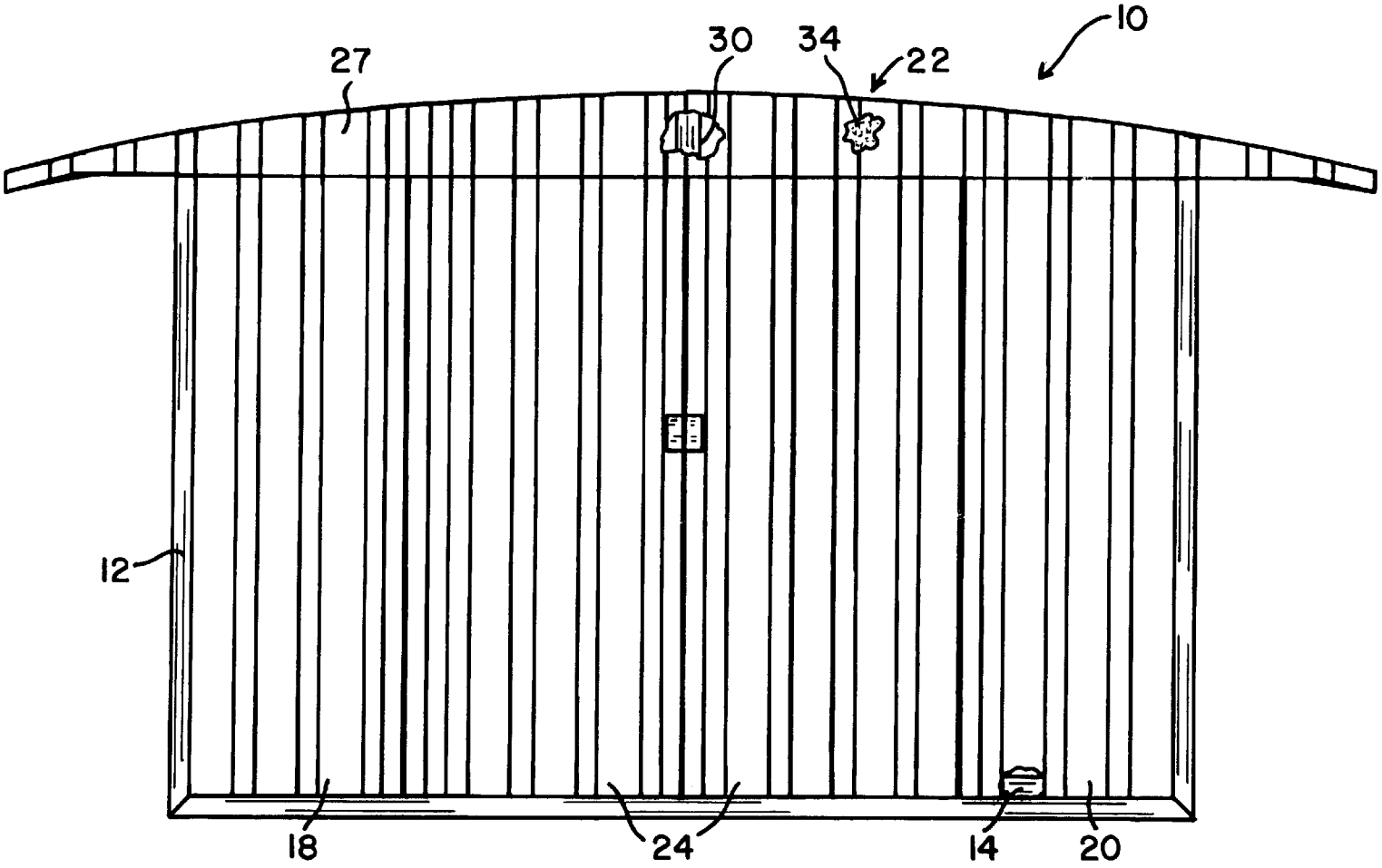
FIG. 1 is substantially a frontal view showing the preferred embodiment for a building constructed using the method of the present invention.
Figure 2:
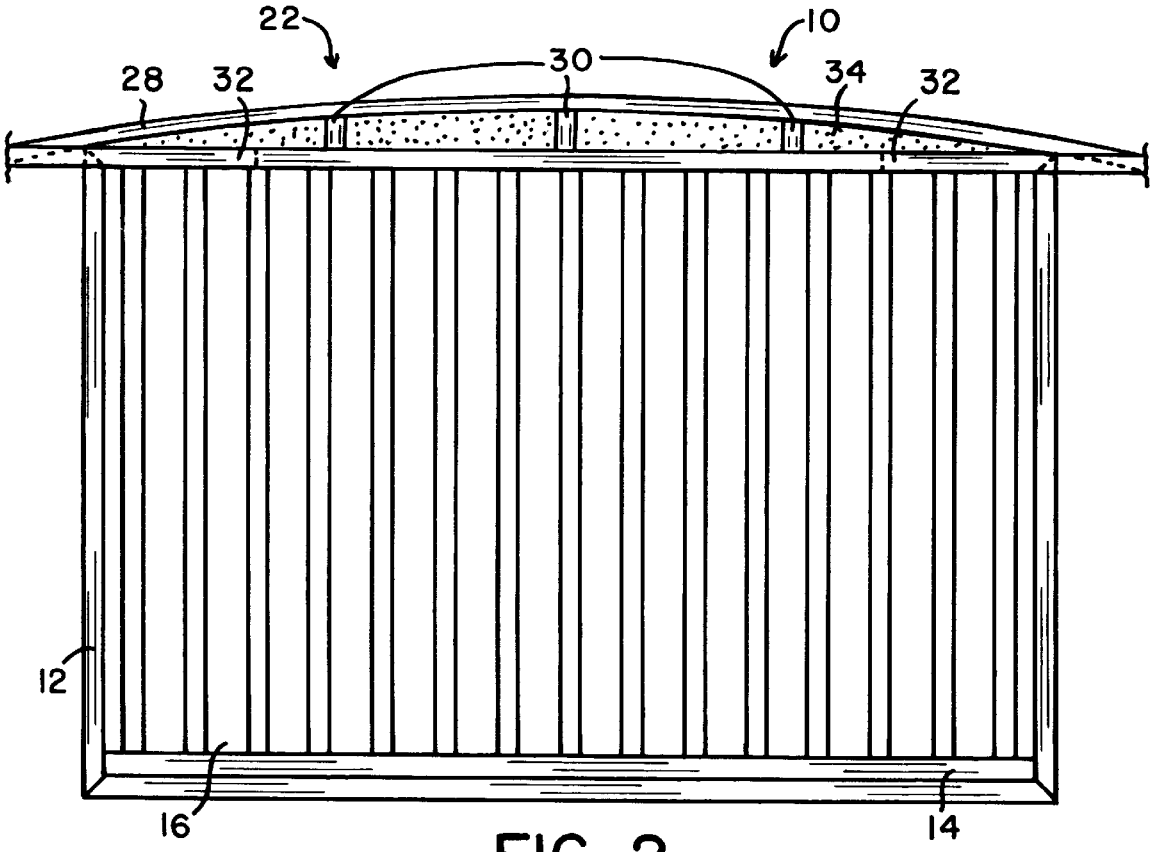
FIG. 2 is substantially a partial plan view for constructing the floor, roof, rear wall and side walls.
Figure 3:
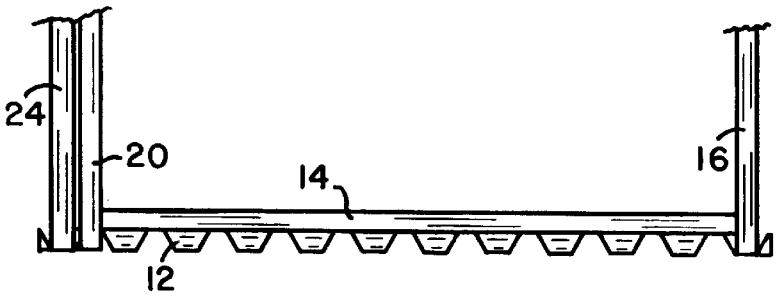
FIG. 3 is substantially a partial plan view for constructing the floor, front and rear walls, and sliding doors.

As depicted in FIGS. 1–3, (10) is an overview of the preferred embodiment for the building of the present invention. The building (10) substantially comprises a support base sheet (12), an interior floor sheet (14), a backside wall sheet (16), a front left wall sheet (18), a front right wall sheet (20), a roof (22) and open/closure means.

It is to be understood that any suitable open/closure means may be used, such as a door of any type, or as depicted in FIG. 1, sliding doors (24) are very convenient. Also, the roof (22) may be formed in numerous manners such as from only one corrugated sheet which forms a flat roof, or it can be formed from at least two interconnected corrugated sheets which form a curved roof, as later described herein.

Referring now to FIG. 2, which substantially illustrates the preferred assembly and construction for erecting building (10). However, the building (10) as depicted therein is only partially completed and does not include wall sheets (18 & 20) nor open/closure means (24), this allows the following assembly description to be clearly visually conceived.

Whereby, support base sheet (12) is formed from one length of a corrugated sheet having a central section which functions as a support base, and two opposing ends which when bent upward at a 90 degree angle respectively, form two opposing side walls. It is to be understood that any suitable means for bending and/or forming the side walls of engineering choice may be used. However, the unique bending method such as taught in our previously issued U.S. Pat. No. 6,354,130, entitled "METHOD FOR BENDING A CORRUGATED SHEET", is most functional and very economical. It is to be also understood that if so desired, support base sheet (12) may be bent at the top section of each of the side walls and interconnected together by suitable fastening means. Whereby, support base sheet (12) would also form the roof, and the roof could be either flat, or it could be bent to form various configurations of choice. However, the following description depicts the preferred embodiment as this provides a roof having unique characteristics and improved strength.

Construction of roof (22) includes a first corrugated roof sheet (26), a second corrugated roof sheet (28), multiple spacers (30) and fascia (27). The embodiment as depicted in FIG. 2 teaches the two opposing ends of support base sheet (12) being bent inwardly towards each other at the top section of each of the side walls so as to form two opposing spaced apart legs (32) respectively, which provide support and attachment means for supporting and attaching roof (22) thereon and also provides highly increased strength and the support legs and roof (22) are fixedly attached in place by suitable fasteners, such as screws (not shown). First corrugated roof sheet (26) and second corrugated roof sheet (28) being spaced apart from each other by multiple spacers (30) which are of various sizes and positioned at equally spaced apart intervals upon first roof sheet (26). The largest of spacers (30) being positioned centrally on top of first roof sheet (26) and smaller spacers which decrease in size are dispersed outwardly away from the center of first roof sheet (26) toward the opposing outer edges of first roof sheet (26), and each of the spacers (30) are fixedly attached in place by suitable fasteners. Whereby, when second roof sheet (28) is positioned and fixedly attached by suitable fasteners on top of the various spacers (30) and the outer edges of each roof sheet (26 & 28) are fixedly attached together by suitable fasteners, each roof sheet (26 & 28) and spacers (30) in combination form a very strong curved roof (22). Furthermore, this construction for the roof eliminates the need for trusses normally required for typical roofs, as the stresses are dispersed outwardly substantially toward the outer edges of each roof sheet. This further allows if so desired, for the roofs edges to be easily extended outwardly, such as to form a carport. This is most advantageous as due to its construction and increased strength, this allows for a longer span without the need for additional supports, which are currently within the known prior art a necessity.

It is to be understood that each of the spacers (30) can be made from any suitable material of choice, such as from prior art I-beams, wood, metal, etc.

Roof (22) may further include insulation (34) that is inserted and positioned in between spacers (30), if an insulated roof is desired. For final finish of roof (22) the sides thereof are covered with fascia (27), not only for enclosing the roof sides but also for esthetic purposes as well, and fascia (27) can be made from any suitable material of engineering choice, such as a corrugated sheet, wood, siding, or the like, and fascia (27) is fixedly attached in place by any suitable fasteners, such as screws (not shown).

It is to be understood that when constructing large buildings using the present method, shoring (not shown) is included which provides additional strength and allows workers to walk thereon in a safe and efficient manner. Therefore, it is to be understood that the roof as illustrated herein is only exemplary of one possible embodiment. Thus the invention is not to be limited to a roof that is constructed in the manner as taught herein, but is to include other suitable configurations and sizes of choice as well.

Referring now to FIG. 3, which substantially represents a partial plan view for assembly and construction of the interior floor sheet (14), backside wall sheet (16), front wall sheets (18 & 20) and sliding doors (24). Wherein as depicted, the previously noted central section of support base sheet (12) functions as a support base for supporting interior floor sheet (14), as central section of support base sheet (12) and interior floor sheet (14) are of the same shape and size so as to have a mating relationship there between and are fixedly attached together by suitable attachment means.

As further illustrated in FIGS. 2 & 3, it can clearly be seen that support base sheet (12) and first roof sheet (26) of roof (22) in combination provide support and attachment means for supporting and attaching backside wall sheet (16) onto support base sheet (12) and roof (22). Support base sheet (12) and roof (22) in combination further provide support and attachment means for supporting and attaching open/ closure means onto support base sheet (12) and roof (22), and one type of a suitable open/closure means is exemplified by sliding doors (24). For example, being that support base sheet (12) and first roof sheet (26) are corrugated, namely having interconnected valleys and ridges, with the valleys being of the perfect shape and size to support and receive backside wall sheet (16) and open/closure means such as sliding doors (24) therein.

To further clarify, support base sheet (12) provides a first upwardly facing recess or valley which is of a shape and size to slidably receive the bottom edge of the open/closure means, namely each sliding door (24) therein and first roof sheet (26) provides a first downwardly facing recess or valley which is of a shape and size to receive the top edge of open/closure means, namely each sliding door (24) therein. Whereby, first upwardly facing recess and first downwardly facing recess are substantially opposed to each other, and in combination form suitable support means for slidably retaining doors (24) there between.

Support base sheet (12) further provides a second upwardly facing recess or valley which is of a shape and size to receive and secure the bottom edge of backside wall sheet (16) therein and first roof sheet (26) provides a second downwardly facing recess or valley which is of a shape and size to receive the top edge of backside wall sheet (16) therein. Whereby, second upwardly facing recess and second downwardly facing recess are substantially opposed to each other, and in combination form suitable support means for retaining backside wall sheet (16) there between and backside wall sheet (16) is fixedly attached in place by suitable fasteners. While sliding doors (24) are slidably engaged in between first recesses which allow the doors (24) to be easily slidably moveably positioned between an open and closed position.

Support base sheet (12) and roof (22)in combination provide support and attachment means for supporting and attaching front left wall sheet (18) and front right wall sheet (20)onto support base sheet (12) and roof (22). For example, support base sheet (12) further provides a third upwardly facing recess or valley which is of a shape and size to receive and secure the bottom edge of front left wall sheet (18) and front right wall sheet (20) therein and first roof sheet (26) provides a third downwardly facing recess or valley which is of a shape and size to receive and secure the top edge of front left wall sheet (18) and front right wall sheet (20) therein. Whereby, third upwardly facing recess and third downwardly facing recess are substantially opposed to each other, and in combination form suitable support means for retaining and supporting front left wall sheet (18) and front right wall sheet (20) there between, and front left wall sheet (18) and front right wall sheet (20) are fixedly attached in place by suitable fasteners, such as screws (not shown).

It is to be understood the assembly as described above is only exemplary and the invention is not to be limited to this construction alone, as many different configurations and alterations can be incorporated depending on consumer or engineering choice.

Also, building (10) can include various accessories of consumer or manufacturing choice, such as windows, skylights, vents, shelves, a floor covering, etc.

Another alternative for building (10) includes swinging doors, which again can be made from any suitable material of engineering choice, such as from corrugated sheets, wood, aluminum, etc.

It is to be understood that each of the components of building (10) include framing means (not shown) thereon so as to provide a finished running edge and also provide a suitable attachment surface for each of the fasteners.

It is to be understood throughout the application where ever suitable fasteners are mentioned, it is intended that such fasteners are of engineering choice, such as screws washers and nuts, or the like. However, being there are so many different types of suitable fasteners that are very well known, such fasteners are not depicted herein for clarity purposes.

It can now be seen we have herein provided a method and apparatus for constructing a building from interconnecting corrugated sheets which is quick and easy to assemble, economical to produce and sell. Also, the building is rot-resistant, rust-resistant, weather resistant, seismically sound, extremely strong, even when subjected to high winds and can be used for any suitable purpose of user choice.

Although the invention has been shown and described in what is conceived to be the most practical and preferred embodiment, it is recognized that departures may be made there from within the scope and spirit of the invention, which is not to be limited to the details disclosed herein but is to be accorded the full scope of the following claims so as to embrace any and all equivalent devices and apparatuses.

What is claimed is:

1. A building which is formed from interconnected corrugated sheets comprising: a support base sheet; an interior floor sheet; a backside wall sheet; a front left wall sheet; a front right wall sheet; a roof which is formed from at least one first corrugated roof sheet; and open/closure means; said support base sheet being formed from one length of a corrugated sheet having a central section and two opposing ends, said central section functions as a support base for supporting said interior floor sheet thereon, said central section and said interior floor sheet being of the same shape and size, said central section and said interior floor sheet being fixedly attached together by attachment means, said two opposing ends being bent upward at a 90 degree angle which form two opposing side walls, said two opposing ends providing support and attachment means for supporting and attaching said roof thereon, said support base sheet and said roof in combination provide support and attachment means for supporting and attaching said backside wall sheet onto said support base sheet and said roof, said support base sheet and said roof in combination provide support and attachment means for supporting and attaching said open/closure means onto said support base sheet and said roof, and said support base sheet and said roof in combination provide support and attachment means for supporting and attaching said front left wall sheet and said front right wall sheet onto said support base sheet and said roof.

2. The building of claim 1 wherein said open/closure means are sliding doors.

3. The building of claim 1 wherein said central section and said interior floor sheet being fixedly attached together is by said attachment means being screws.

4. The building of claim 1 wherein said two opposing ends providing support and attachment means for supporting and attaching said roof thereon, said support and attachment means comprising: said two opposing ends of said support base sheet being bent inwardly towards each other so as to form two opposing legs, and said two opposing legs being fixedly attached to said roof by fasteners.

5. The building of claim 4 wherein said fasteners are screws.

6. The building of claim 1 wherein said roof which is formed from at least one first corrugated roof sheet further includes a second corrugated roof sheet; multiple spacers; and fascia; said first corrugated roof sheet and said second corrugated roof sheet being spaced apart from each other by said multiple spacers, said multiple spacers being of various sizes and positioned at equally spaced apart intervals upon said first roof sheet, with the largest of said multiple spacers being positioned centrally on top of said first roof sheet and smaller spacers which decrease in size are dispersed outwardly away from the center of said first roof sheet toward the opposing outer edges of said first roof sheet, each of said multiple spacers being fixedly attached in place by fasteners, said second roof sheet being positioned and fixedly attached by fasteners on top of said multiple spacers, and the outer edges of each said roof sheet being fixedly attached together by fasteners, whereby, each said roof sheet, said fascia and said multiple spacers in combination form a curved roof.

7. The roof of claim 6 further includes insulation which is inserted and positioned in between said multiple spacers.

8. The building of claim 1 wherein said support and attachment means for supporting and attaching said open/closure means onto said support base sheet and said roof comprising: said support base sheet having a first upwardly facing recess which is of a shape and size to slidably receive the bottom edge of said open/closure means therein, said first roof sheet having a first downwardly facing recess which is of a shape and size to receive the top edge of said open/closure means therein, whereby said first upwardly facing recess and said first downwardly facing recess are opposed to each other and in combination form said support and attachment means for supporting and attaching said open/closure means onto said support base sheet and said roof.

9. The building of claim 1 wherein said support and attachment means for supporting and attaching said backside wall sheet onto said support base sheet and said roof comprising: said support base sheet having a second upwardly facing recess which is of a shape and size to receive and secure the bottom edge of backside wall sheet therein, said first roof sheet having a second downwardly facing recess which is of a shape and size to receive the top edge of said backside wall therein, whereby said second upwardly facing recess and said second downwardly facing recess are opposed to each other and in combination form said support and attachment means for supporting and attaching said backside wall sheet onto said support base sheet and said roof and said backside wall sheet are fixedly attached in place by fasteners.

10. The building of claim 9 wherein said fasteners are screws.

11. The building of claim 1 wherein said support and attachment means for supporting and attaching said front left wall sheet and said front right wall sheet onto said support base sheet and said roof comprising: said support base sheet having a third upwardly facing recess which is of a shape and size to receive and secure the bottom edge of said front left wall sheet and said front right wall sheet therein, said first roof sheet having a third downwardly facing recess which is of a shape and size to receive the top edge of said front left wall sheet and said front right wall sheet therein, whereby said third upwardly facing recess and said third downwardly facing recess are opposed to each other and in combination form said support and attachment means for supporting and attaching said front left wall sheet and said front right wall sheet onto said support base sheet and said front left wall sheet and said front right wall sheet being fixedly attached in place by fasteners.

* * * * *